US011047352B2

(12) United States Patent
Yamamoto et al.

(10) Patent No.: US 11,047,352 B2
(45) **Date of Patent: *Jun. 29, 2021**

(54) FUEL INJECTION VALVE

(71) Applicant: DENSO CORPORATION, Kariya (JP)

(72) Inventors: Shinsuke Yamamoto, Kariya (JP); Kouichi Mochizuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 60 days.

This patent is subject to a terminal disclaimer.

(21) Appl. No.: 16/541,798

(22) Filed: Aug. 15, 2019

(65) Prior Publication Data

US 2019/0368452 A1 Dec. 5, 2019

Related U.S. Application Data

(63) Continuation of application No. 15/564,515, filed as application No. PCT/JP2016/001894 on Apr. 4, 2016, now Pat. No. 10,428,778.

(30) Foreign Application Priority Data

Apr. 7, 2015 (JP) ..... 2015-078329

(51) Int. Cl.
*F02M 51/06* (2006.01)
*F02M 61/10* (2006.01)
(Continued)

(52) U.S. Cl.
CPC ..... *F02M 51/06* (2013.01); *F02M 51/0671* (2013.01); *F02M 51/0682* (2013.01);
(Continued)

(58) Field of Classification Search
CPC .. F02M 51/06; F02M 51/061; F02M 51/0625; F02M 51/0671; F02M 51/0682;
(Continued)

(56) References Cited

U.S. PATENT DOCUMENTS 6,367,769 B1 4/2002 Reiter
6,454,191 B1 9/2002 Spakowski et al.
(Continued)

FOREIGN PATENT DOCUMENTS

EP 1 801 409 6/2007
WO WO2014188765 11/2014

*Primary Examiner* — Darren W Gorman
(74) *Attorney, Agent, or Firm* — Nixon & Vanderhye P.C.

(57) ABSTRACT

A fuel injection valve includes: a housing that includes an injection hole and a valve seat; a needle that includes a flange at a radially outer side of the needle and opens or closes the injection hole; a movable core that is installed on the valve seat side of the flange; a first spring that urges the needle toward the valve seat side; a second spring that urges the movable core toward an opposite side, which is opposite from the valve seat; and a limiting member that is installed on a radially outer side of the needle such that the limiting member enables movement of the movable core between the limiting member and the flange on the valve seat side of the flange. The limiting member includes an outside projection, which supports the second spring; and a tubular portion and an inside projection, which are contactable with the movable core.

2 Claims, 9 Drawing Sheets

(51) Int. Cl.
*F02M 63/00* (2006.01)
*F02M 61/16* (2006.01)

(52) U.S. Cl.
CPC ..... *F02M 51/0685* (2013.01); *F02M 61/10* (2013.01); *F02M 61/168* (2013.01); *F02M 63/00* (2013.01); *F02M 51/061* (2013.01); *F02M 2200/304* (2013.01); *F02M 2200/306* (2013.01)

(58) Field of Classification Search
CPC .. F02M 51/0685; F02M 61/10; F02M 61/168; F02M 63/00; F02M 2200/304; F02M 2200/306
See application file for complete search history.

(56) References Cited

U.S. PATENT DOCUMENTS

| | | | | |
|---|---|---|---|---|
| 6,892,971 | B2 * | 5/2005 | Rieger | F02M 51/0617 239/585.1 |
| 10,309,356 | B2 | 6/2019 | Oikawa et al. | |
| 2012/0080542 | A1 | 4/2012 | Imai | |
| 2013/0277460 | A1 | 10/2013 | Omeri | |
| 2014/0123946 | A1 | 5/2014 | Grandi | |
| 2015/0267665 | A1 | 9/2015 | Abe et al. | |
| 2016/0097358 | A1 | 4/2016 | Miyake | |
| 2017/0067430 | A1 | 3/2017 | Abe et al. | |
| 2018/0238282 | A1 | 8/2018 | Yamamoto et al. | |

* cited by examiner

FUEL INJECTION VALVE

CROSS REFERENCE TO RELATED APPLICATION

This application a continuation of Ser. No. 15/564,515, filed Oct. 5, 2017, which is the U.S. national phase of International Application no. PCT/JP2016/001894 filed Apr. 4, 2016 and claims priority to Japanese Patent Application No. 2015-78329 filed on Apr. 7, 2015, each of which is hereby incorporated by reference.

TECHNICAL FIELD

The present disclosure relates to a fuel injection valve that injects fuel at an internal combustion engine (hereinafter referred to as an engine).

BACKGROUND ART

Previously, there is known a fuel injection valve that injects fuel from an inside to an outside of a housing by opening/closing an injection hole of the housing through reciprocation of a needle. For example, the patent literature 1 recites a fuel injection valve that includes: a movable core; a stationary core; a coil; a needle that is reciprocatable integrally with the movable core and opens or closes an injection hole when the needle moves away from or contacts a valve seat in response to movement of the movable core; a valve closing spring that urges the movable core in a valve closing direction; and a valve opening spring that urges the movable core in a valve opening direction.

In the fuel injection valve of the patent literature 1, one end of the valve opening spring contacts the movable core, and the other end of the valve opening spring contacts a support member that is provided to the housing or the needle. At the time of valve opening of the fuel injection valve of the patent literature 1, when the movable core is excessively moved in the valve closing direction, the valve opening spring is compressed more than a specified amount. When the movable core rebounds due to the urging force of the valve opening spring, which is compressed more than the specified amount, the needle is moved in the valve opening direction once again to execute unexpected fuel injection.

CITATION LIST

Patent Literature

PATENT LITERATURE 1: JP2012-97728A (corresponding to US2012/0080542A1)

SUMMARY OF INVENTION

It is an objective of the present disclosure to provide a fuel injection valve that can limit excessive movement of a movable core in a valve closing direction at a valve closing time.

Means for Achieving Objective

The present disclosure provides a fuel injection valve that includes a housing, a needle member, a stationary core, a movable core, a coil, a first urging member, a second urging member, and a limiting member.

The housing includes an injection hole, through which fuel is injected, and a valve seat, which is formed around the injection hole.

The needle member has a flange, which is formed at a radially outer side of the needle member. When an end part of the needle member, which is located on the valve seat side, moves away from or contacts the valve seat, the needle member opens or closes the injection hole.

The movable core is installed on the valve seat side of the flange such that the movable core is movable relative to the needle member and is contactable with the flange on the valve seat side of the flange.

The limiting member is installed on a radially outer side of the needle member such that the limiting member enables movement of the movable core between the limiting member and the flange on the valve seat side of the flange.

The fuel injection valve of the present disclosure is characterized by that the limiting member includes a support portion, which supports another end of the second urging member, and a contact portion, which is contactable with the movable core on the valve seat side of the movable core, and the limiting member is capable of limiting movement of the movable core relative to the needle member toward the valve seat side when the movable core contacts the contact portion.

The fuel injection valve of the present disclosure has the limiting member that includes: the support portion, which supports the another end of the second urging member; and the contact portion, which is contactable with the movable core on the valve seat side of the movable core. At the time of valve closing of the fuel injection valve of the present disclosure, the movable core is moved integrally with the needle member in the valve closing direction. Although the needle member stops movement in the valve closing direction upon contacting of the needle member against the valve seat, the movable core is moved further in the valve closing direction by an inertial force. At this time, the movable core, which moves in the valve closing direction, contacts the contact portion of the limiting member, so that excessive movement of the movable core in the valve closing direction is limited. In this way, it is possible to limit reopening of the injection hole that would be made by movement of the needle member in the valve opening direction due to rebound of the movable core, which has moved excessively in the valve closing direction.

DESCRIPTION OF EMBODIMENTS

Hereinafter, various embodiments of the present disclosure will be described with reference to the drawings.

First Embodiment

Figure 1:
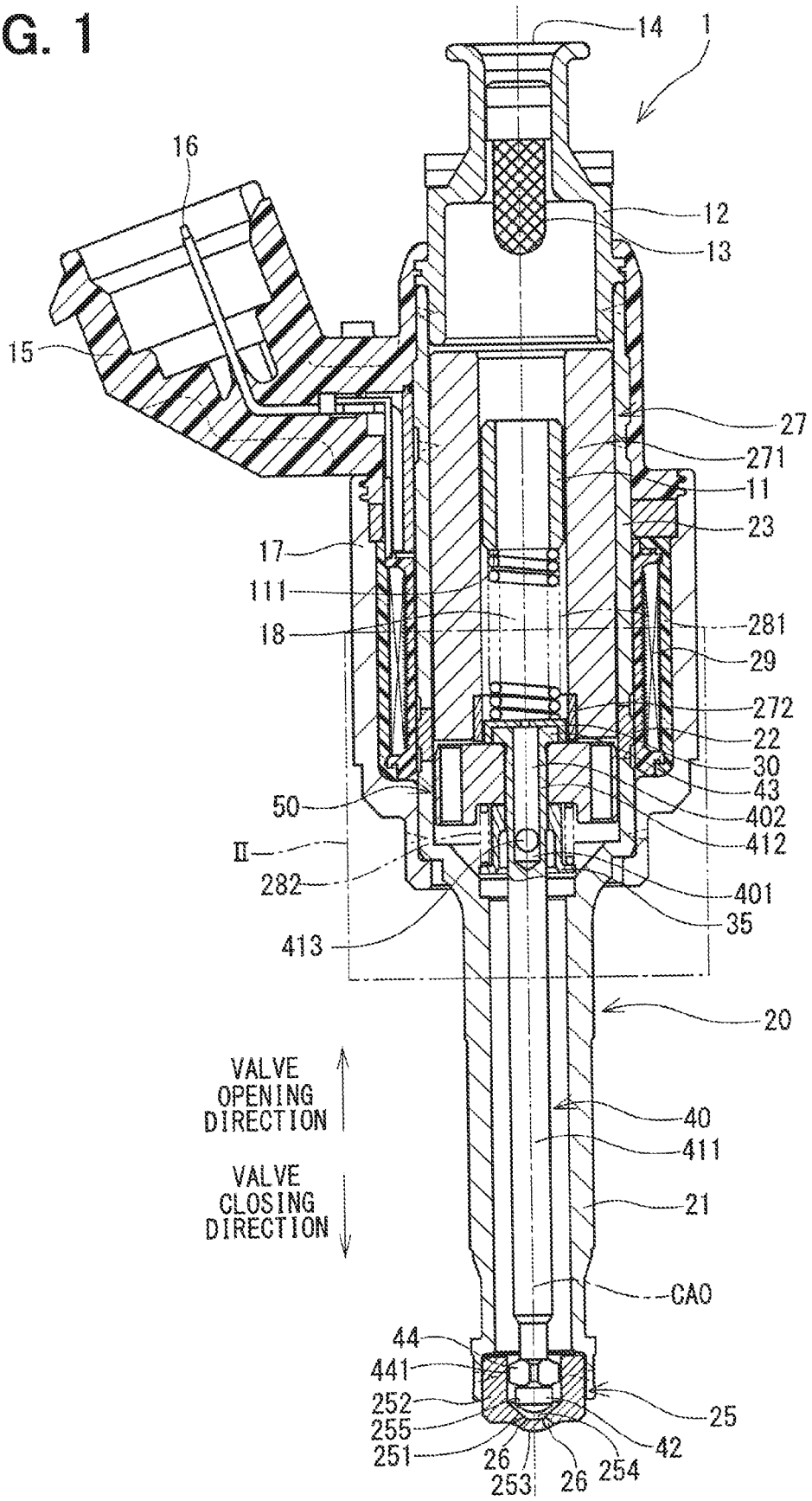
FIG. 1 is a cross-sectional view of a fuel injection valve according to a first embodiment of the present disclosure.
Figure 2:
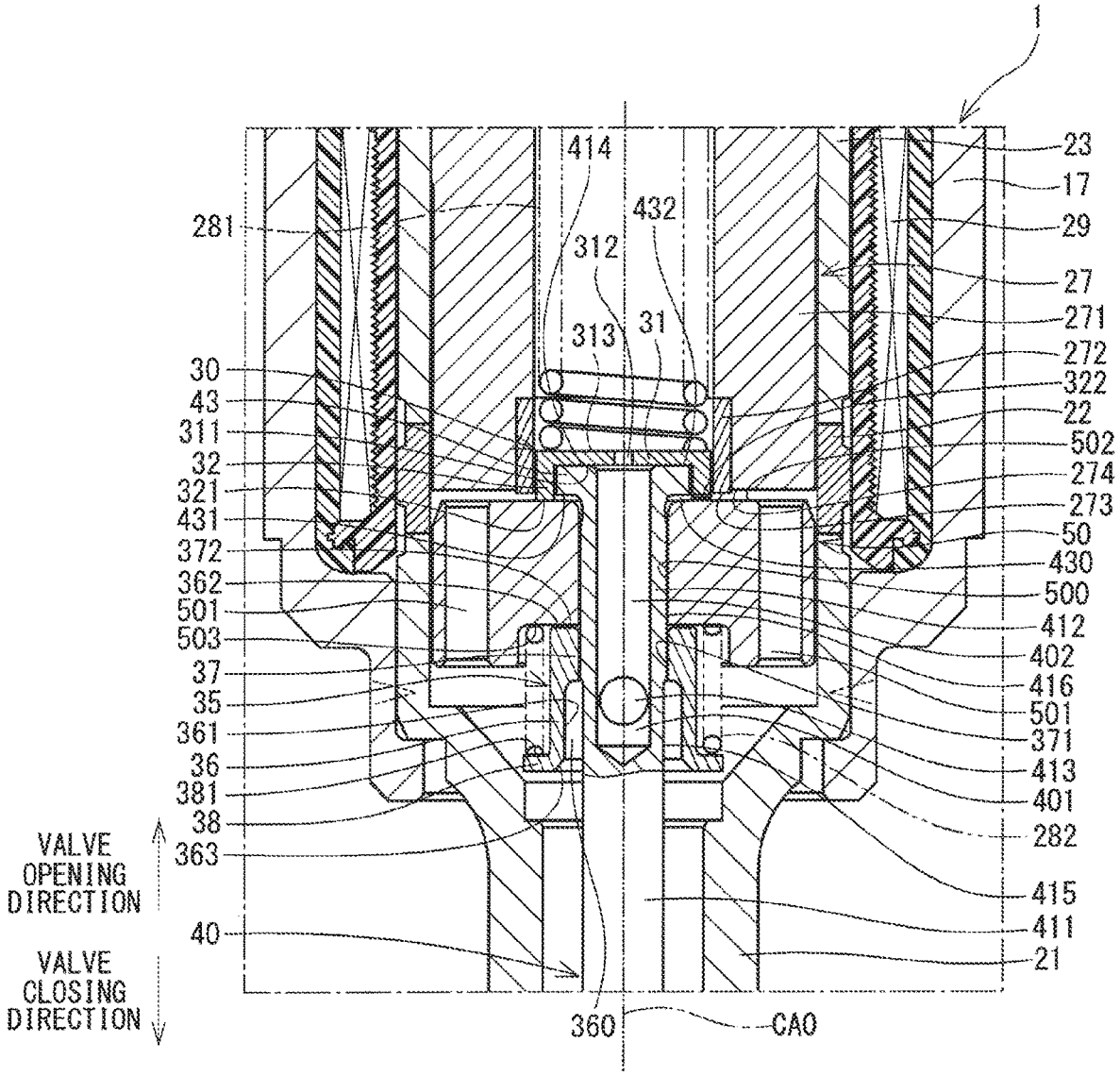
FIG. 2 is an enlarged view of a portion II in FIG. 1.

FIGS. 1 and 2 show a fuel injection valve 1 according to a first embodiment of the present disclosure. FIGS. 1 and 2 show a valve opening direction, which is a moving direction of a needle 40 away from a valve seat 255, and a valve closing direction, which is a moving direction of the needle 40 toward the valve seat 255 for contacting with the valve seat 255.

The fuel injection valve 1 is used in, for example, a fuel injection device of an undepicted direct injection type gasoline engine and injects gasoline as fuel at a high pressure in the engine. The fuel injection valve 1 includes a housing 20, a needle 40, a movable core 50, a stationary core 27, a flange receiving member (serving as a gap forming member) 30, a limiting member 35, a coil 29, a first spring (serving as a first urging member) 281, and a second spring (serving as a second urging member) 282.

As shown in FIG. 1, the housing 20 includes a first tubular member 21, a second tubular member 22, a third tubular member 23 and an injection nozzle 25. The first tubular member 21, the second tubular member 22 and the third tubular member 23 are respectively formed as a cylindrical tubular member. The first tubular member 21, the second tubular member 22 and the third tubular member 23 are coaxially arranged in this order and are joined together.

The first tubular member 21 and the third tubular member 23 are made of a magnetic material, such as ferritic stainless steel, and are magnetically stabilized through a magnetic stabilization process. In contrast, the second tubular member 22 is made of a non-magnetic material, such as austenitic stainless steel.

The injection nozzle 25 is welded to an end part of the first tubular member 21, which is opposite from the second tubular member 22. The injection nozzle 25 is a bottomed tubular member made of metal, such as martensitic stainless steel. The injection nozzle 25 is quenched to have a predetermined hardness. The injection nozzle 25 includes an injecting portion 251 and a tubular portion 252.

The injecting portion 251 is shaped into a form that is symmetrical about a central axis CAO of the housing 20, which serves as a line of symmetry and is coaxial with a central axis of the fuel injection valve 1. An outer wall 253 of the injecting portion 251 is formed to project from an inside of the injection nozzle 25 toward an outside of the injection nozzle 25. The injecting portion 251 has a plurality of injection holes 26, which communicate between the inside of the housing 20 and the outside of the housing 20. A valve seat 255 is formed at an inner wall 254 of the injecting portion 251 at a location around inside openings of the injection holes 26.

The tubular portion 252 is formed at a radially outer side of the injecting portion 251 such that the tubular portion 252 extends in an opposite direction that is opposite from the projecting direction of the outer wall 253 of the injecting portion 251. One end part of the tubular portion 252 is joined to the injecting portion 251, and the other end part of the tubular portion 252 is joined to the first tubular member 21.

The needle 40 is made of metal, such as martensitic stainless steel. The needle 40 is quenched to have a hardness that is generally equal to the hardness of the injection nozzle 25.

The needle 40 is received in the inside of the housing 20 in a manner that enables reciprocation of the needle 40. The needle 40 includes a small diameter portion 411, a large diameter portion 412, a seal portion 42, a slidable portion 44 and a flange 43. The small diameter portion 411, the large diameter portion 412, the seal portion 42 and the flange 43 are formed integrally in one-piece. The small diameter portion 411, the large diameter portion 412, the seal portion 42 and the flange 43 correspond to a needle member of the present disclosure.

The small diameter portion 411 is shaped into a rod form and is placed in the inside of the first tubular member 21 in a manner that enables reciprocation of the small diameter portion 411. The seal portion 42 is formed on the valve seat 255 side of the small diameter portion 411. The large diameter portion 412 is formed on an opposite side of the small diameter portion 411, which is opposite from the valve seat 255. The end part of the small diameter portion 411, which is located on the side where the large diameter portion 412 is formed, includes a flow passage 401. The flow passage 401 serves as a fuel flow passage, through which the fuel is flowable. The flow passage 401 is communicated with openings 413, each of which serves as a fuel flow passage and is formed to extend through a wall of the small diameter portion 411 in a radial direction.

The large diameter portion 412 is a portion that is shaped into a generally tubular form. An outer diameter of the large diameter portion 412 is larger than an outer diameter of the small diameter portion 411. The large diameter portion 412 includes a flow passage 402 that is communicated with an opposite side of the needle 40, which is opposite from the valve seat 255, while the flow passage 402 serves as a fuel flow passage, through which the fuel is flowable. The flow passage 402 is communicated with the flow passage 401 of the small diameter portion 411.

The seal portion 42 is abuttable against the valve seat 255. When the seal portion 42 moves away from or contacts the valve seat 255, the needle 40 opens or closes the injection holes 26 to communicate or discommunicate between the inside and the outside of the housing 20.

The slidable portion 44 is formed at the seal portion 42 side of the small diameter portion 411. Parts of an outer wall 441 of the slidable portion 44 are chamfered. Remaining parts of the outer wall 441 of the slidable portion 44, which are not chamfered, are slidable along the inner wall of the injection nozzle 25. In this way, reciprocation of the needle 40 is guided at an end part of the needle 40 located on the valve seat 255 side.

The flange 43 is a portion that is shaped into a generally circular ring form. The flange 43 is formed at a radially outer side of an end part of the large diameter portion 412, which is opposite from the valve seat 255. An end surface 431 of the flange 43, which is located on the valve seat 255 side, is contactable with the movable core 50. An end surface 432 of the flange 43, which is opposite from the valve seat 255, is formed to be flush with an end surface 414 of the large diameter portion 412, which is located on the valve seat 255 side.

The movable core 50 is a generally tubular member that is made of a magnetic material, such as ferritic stainless steel. The movable core 50 is placed on the valve seat 255 side of the flange 43 in such a manner that the movable core 50 is movable relative to the needle 40.

The movable core 50 includes a receiving hole 500, through which the large diameter portion 412 is received. The movable core 50 includes a plurality of communication passages 501, which are located on the radially outer side of the receiving hole 500 and communicate between the valve seat 255 side of the movable core 50 and an opposite side of the movable core 50, which is opposite from the valve seat 255. The fuel flows through the communication passages 501.

An end surface 502 of the movable core 50, which is opposite from the valve seat 255, is formed to be contactable with the end surface 431 of the flange 43 and the stationary core 27. As shown in FIG. 2, in a state where the plate portion 31 of the flange receiving member 30 contacts the large diameter portion 412 and the flange 43, and the tubular portion 32 of the flange receiving member 30 contacts the movable core 50, a gap 430 is formed between the end surface 502 and the end surface 431.

The stationary core 27 is welded to the third tubular member 23 of the housing 20 and is fixed to the inside of the housing 20. The stationary core 27 includes a stationary core main body portion 271 and a stationary core slidable portion 272.

The stationary core main body portion 271 is made of a magnetic material, such as ferritic stainless steel. The stationary core main body portion 271 is magnetically stabilized through a magnetic stabilization process and is placed in a magnetic field, which will be described later and is formed by the coil 29.

The stationary core slidable portion 272 is a tubular member that is placed in an inside of an end part of the stationary core main body portion 271, which is located on the valve seat 255 side. For example, chromium plating is applied to a surface of the stationary core slidable portion 272, so that the stationary core slidable portion 272 has a hardness that is generally equal to the hardness of the flange receiving member 30, the hardness of the flange 43 and the hardness of the movable core 50. As shown in FIG. 2, the stationary core slidable portion 272 is formed such that an end surface 273 of the stationary core slidable portion 272, which is located on the valve seat 255 side, is placed on the valve seat 255 side of an end surface 274 of the stationary core main body portion 271, which is located on the valve seat 255 side. Thereby, when the movable core 50 moves in the valve opening direction, the end surface 502 of the movable core 50 contacts the end surface 273 of the stationary core slidable portion 272, so that movement of the movable core 50 in the valve opening direction is limited.

The flange receiving member 30 is located on the radially inner side of the stationary core slidable portion 272 and is placed between the first spring 281 and the movable core 50. The flange receiving member 30 includes the plate portion 31 and the tubular portion 32. The plate portion 31 and the tubular portion 32 are formed integrally in one-piece.

The plate portion 31 is located on an opposite side of the flange 43, which is opposite from the valve seat 255. The plate portion 31 includes an end surface 311 that is contactable with the end surface 414 of the large diameter portion 412 and the end surface 432 of the flange 43. The plate portion 31 includes a through-hole 312 that extends through the plate portion 31 in an axial direction of the central axis CAO. The through-hole 312 communicates between an outside and an inside of the flange receiving member 30.

The tubular portion 32 is a portion that is shaped into a tubular form such that the tubular portion 32 extends from a radially outer end part of the plate portion 31 in the direction toward the valve seat 255. The tubular portion 32 has an inner wall that is formed to be slidable with an outer wall of the flange 43 located at the radially outer side. The outer wall of the tubular portion 32 is formed to be slidable with an inner wall of the stationary core slidable portion 272.

An end surface 321 of the tubular portion 32, which is located on the valve seat 255 side, is formed to be contactable with the end surface 502 of the movable core 50. The tubular portion 32 has a length that enables reciprocation of the flange 43 in the inside of the flange receiving member 30. The tubular portion 32 includes a communication passage 322 that communicates between the inside and the outside of the tubular portion 32. The communication passage 322 is communicatable with the gap 430.

The coil 29 is shaped into a tubular form and mainly surrounds a radially outer side of the second tubular member 22 and the third tubular member 23. The coil 29 generates the magnetic field therearound when an electric power is supplied to the coil 29. When the magnetic field is formed, a magnetic circuit is formed at the stationary core 27, the movable core 50, the first tubular member 21, the third tubular member 23 and the holder 17.

One end of the first spring 281 contacts an end surface 313 of the plate portion 31, which is opposite from the valve seat 255. The other end of the first spring 281 contacts an end surface 111 of an adjusting pipe 11, which is located on the valve seat 255 side, while the adjusting pipe 11 is securely press fitted into the inside of the stationary core 27. The first spring 281 urges the needle 40 toward the valve seat 255 side, i.e., urges the needle 40 in the valve closing direction.

One end of the second spring 282 contacts an end surface 503 of the movable core 50, which is located on the valve seat 255 side. The other end of the second spring 282 is supported by the limiting member 35, and thus the limiting member 35 corresponds to a spring retainer for retaining the other end of the second spring 282. The second spring 282 urges the movable core 50 toward the side, which is opposite from the valve seat 255, i.e., urges the movable core 50 in the valve opening direction.

An urging force of the second spring 282 is set to be smaller than an urging force of the first spring 281. In this way, when the electric power is not supplied to the coil 29, the seal portion 42 of the needle 40 is placed in a contact state where the seal portion 42 contacts the valve seat 255, i.e., in a valve closing state.

The limiting member 35 is a member that is shaped into a generally tubular form and is placed at a location, which is on the valve seat 255 side of the flange 43 and is on a radially outer side of the small diameter portion 411 and the large diameter portion 412. The limiting member 35 is fixed to the needle 40 by, for example, press fitting. The limiting member 35 includes: a tubular portion 36, which serves as a communication passage forming portion; an inside projection 37, which serves as a movable core side end part and a fixing portion; and an outside projection 38, which serves as a support portion. The tubular portion 36 and the inside projection 37 correspond to a contact portion of the present disclosure.

The tubular portion 36 is placed on the radially outer side of the small diameter portion 411 and the large diameter portion 412. A communication passage 360 is formed between an inner wall 361 of the tubular portion 36 and an outer wall 415 of the small diameter portion 411. The communication passage 360 communicates between the openings 413 of the small diameter portion 411 and the outside of the limiting member 35. An end surface 362 of the tubular portion 36, which is opposite from the valve seat 255, is formed to be contactable with the end surface 503 of the movable core 50. The inner edge section 363 of the tubular portion 36, which is located on the valve seat 255 side, has a slope surface that is progressively spaced away from a central axis CAO of the tubular portion 36, which is coaxial with the central axis of the limiting member 35, from the opposite side, which is opposite from the valve seat 255, toward the valve seat 255 side.

The inside projection 37 is placed on the radially inner side of the tubular portion 36. The inside projection 37 is formed to project from an end part of the tubular portion 36, which is opposite from the valve seat 255, in a radially inner direction of the tubular portion 36. An inner wall 371 of the inside projection 37 is fixed to an outer wall 416 of the large diameter portion 412. An end surface 372 of the inside projection 37, which is opposite from the valve seat 255, is flush with the end surface 362 of the tubular portion 36 and is formed to be contactable with the end surface 503 of the movable core 50.

The outside projection 38 is formed to project from an end part of the tubular portion 36, which is located on the valve seat 255 side, toward a radially outer side of the tubular portion 36. An end surface 381 of the outside projection 38, which is opposite from the valve seat 255, supports the second spring 282.

A fuel inlet pipe 12, which is shaped into a tubular form, is press fitted into and is welded to an end part of the third tubular member 23, which is opposite from the second tubular member 22. A filter 13 is installed in an inside of the fuel inlet pipe 12. The filter 13 collects foreign objects contained in fuel, which flows from an inlet 14 of the fuel inlet pipe 12 to the filter 13.

A radially outer side of the fuel inlet pipe 12 and a radially outer side of the third tubular member 23 are insert molded by resin. A connector 15 is formed at this molded portion. Terminals 16, through which the electric power is supplied to the coil 29, are insert molded in the connector 15. A holder 17, which is shaped into a tubular form and covers the coil 29, is placed on a radially outer side of the coil 29.

The fuel, which is inputted from the inlet 14 of the fuel inlet pipe 12, flows in the inside of the stationary core 27, the inside of the adjusting pipe 11, the through-hole 312, the flow passages 402, 401, the openings 413, the communication passage 360, and the gap between the first tubular member 21 and the small diameter portion 411 and is guided into the inside of the injection nozzle 25. Furthermore, a portion of the fuel, which flows in the inside of the adjusting pipe 11, flows through the communication passages 501 and the gap between the first tubular member 21 and the limiting member 35 and is guided into the inside of the injection nozzle 25. That is, the passage from the inlet 14 of the fuel inlet pipe 12 to the gap between the first tubular member 21 and the small diameter portion 411 serves a fuel passage 18, which guides the fuel into the inside of the injection nozzle 25.

Next, the operation of the fuel injection valve 1 will be described.

When the electric power is not supplied to the coil 29, the seal portion 42 of the needle 40 contacts the valve seat 255. At this time, the needle 40, the movable core 50 and the flange receiving member 30 have the positional relationship shown in FIG. 2. Specifically, a magnetic attractive force is not generated between the stationary core 27 and the movable core 50, so that a gap is formed between the stationary core 27 and the movable core 50. Furthermore, the large diameter portion 412 and the flange 43 contact the plate portion 31, and the tubular portion 32 contacts the movable core 50. Thus, the gap 430 is formed. The gap 430 is filled with the fuel that flows in the fuel passage 18.

When the electric power is supplied to the coil 29, the magnetic attractive force is generated between the stationary core 27 and the movable core 50. Thereby, in response to balance among the urging force of the first spring 281, the urging force of the second spring 282 and the magnetic attractive force, the movable core 50 moves and accelerates in the valve opening direction through a distance, which corresponds to a length of the gap 430 in the axial direction of the central axis CAO, and then the end surface 502 of the movable core 50 contacts the end surface 431 of the flange 43. At this time, the fuel in the gap 430 outflows to the outside of the flange receiving member 30 through the communication passage 322 of the tubular portion 32.

Furthermore, the movable core 50 moves in the valve opening direction while maintaining the contact between the end surface 502 of the movable core 50 and the end surface 431 of the flange 43. Thereby, the seal portion 42 moves away from the valve seat 255, so that the injection holes 26 are opened. When the injection holes 26 are opened, the fuel, which is guided into the inside of the injection nozzle 25, is injected to the outside through the injection holes 26. When the movable core 50, which moves in the valve opening direction, contacts the stationary core slidable portion 272, the movement of the movable core 50 in the valve opening direction is stopped.

When the supply of the electric power to the coil 29 is stopped, the magnetic attractive force, which is generated between the stationary core 27 and the movable core 50, is lost. Therefore, the movable core 50 and the flange receiving member 30 move in the valve closing direction in response to the urging force of the first spring 281 and the urging force of the second spring 282. When the movable core 50 and the flange receiving member 30 move in the valve closing direction, the end surface 414 and the end surface 431 contact the end surface 311. In this way, the needle 40 moves along with the movable core 50 and the flange receiving member 30 in the valve closing direction.

When the seal portion 42 contacts the valve seat 255 upon movement of the needle 40 in the valve closing direction, the injection holes 26 are closed. Thereby, the injection of the fuel is terminated. When the seal portion 42 contacts the valve seat 255, the movement of the needle 40 in the valve closing direction is stopped. However, the movable core 50 is moved by the inertial force in the valve closing direction. At this time, a moving velocity of the movable core 50 in the valve closing direction is progressively reduced by the urging force of the second spring 282. However, in a case where the moving velocity of the movable core 50 is not sufficiently reduced, the movable core 50 contacts the end surfaces 362, 372 of the limiting member 35 and thereby stops the movement in the valve closing direction.

The fuel injection valve 1 of the first embodiment includes the limiting member 35, which supports the second spring 282 and is contactable with the movable core 50.

At the time of valve closing of the fuel injection valve 1, which has been in the valve opening state, the movable core 50 and the needle 40 are integrally moved in the valve closing direction. The movable core 50 moves further in the valve closing direction even when the needle 40 stops the movement thereof in the valve closing direction upon contacting of the needle 40 to the valve seat 255. The limiting member 35 is formed to enable reciprocation of the movable core 50 between the limiting member 35 and the flange 43. The limiting member 35 limits excessive movement of the movable core 50 in the valve closing direction after the contacting of the needle 40 to the valve seat 255. In this way, it is possible to limit reopening of the injection holes 26 that would be otherwise caused by the movement of the needle 40 in the valve opening direction through rebound of the movable core 50 that is rebounded upon the excessive movement of the movable core 50 in the valve closing direction.

The limiting member 35 is placed on the radially outer side of the small diameter portion 411 and the large diameter portion 412 and supports one end of the second spring 282. With this configuration, the urging force of the second spring 282 can be adjusted by adjusting a distance between the limiting member 35 and the movable core 50 at the time of manufacturing the fuel injection valve 1. Thereby, the urging force of the second spring 282 can be adjusted with high accuracy.

Previously, the urging force of the urging member, which urges the movable core in the valve opening direction, is adjusted at the time of manufacturing the fuel injection valve in a state where the urging member, the needle and the movable core are installed to the housing that supports one end of the urging member. Therefore, the adjustment of the urging force of the urging member is relatively difficult, and the number of steps required for the adjustment is increased.

In the fuel injection valve 1, the urging force of the second spring 282 can be adjusted based only on the relationship between the limiting member 35 and the movable core 50. Thereby, the urging force can be relatively easily adjusted in comparison to the case where the one end of the urging means for urging the movable core in the valve opening direction is supported by the housing.

Furthermore, in the case of the fuel injection valve 1, the urging force of the second spring 282 can be adjusted at the needle assembling step that assembles the movable core 50 and the needle 40 together. Therefore, there is no need for the injector assembling step that adjusts the urging force of the urging member after the assembling of the urging member, the needle and the movable core to the housing. Thereby, the number of the manufacturing steps of the fuel injection valve can be reduced.

The communication passage 360, which forms the fuel passage 18, is formed between the inner wall 361 of the tubular portion 36 and the outer wall 415 of the small diameter portion 411. Thereby, the required amount of fuel, which is required for the fuel injection, can be reliably conducted from the inlet 14 of the fuel inlet pipe 12 to the inside of the injection nozzle 25.

The inner edge section 363 of the tubular portion 36, which is located on the valve seat 255 side, has a slope surface that is progressively spaced away from a central axis CAO of the tubular portion 36, which is coaxial with the central axis of the limiting member 35, from the opposite side, which is opposite from the valve seat 255, toward the valve seat 255 side. Therefore, the fuel can be smoothly outputted from the communication passage 360 to the outside of the limiting member 35.

The inside projection 37 of the limiting member 35, which is formed at the opposite end part of the tubular portion 36 that is opposite from the valve seat 255, is securely press fitted to the large diameter portion 412, and thus the large diameter portion 412 corresponds to a press-fitting segment of the needle member. Thus, at the valve closing time of the fuel injection valve 1, an impact force, which is exerted at the time of colliding the movable core 50 against the limiting member 35 upon movement of the movable core 50 in the valve closing direction, can be received with the inside projection 37. Therefore, it is possible to limit occurrence of a damage of the limiting member 35 that would be otherwise caused by the impact force exerted at the time of colliding the movable core 50 against the limiting member 35.

In the fuel injection valve 1, at the valve opening time, the movable core 50 moves and accelerates in the valve opening direction through the distance that corresponds to the length of the gap 430 in the axial direction of the central axis CAO. The end surface 502 of the movable core 50 contacts the end surface 431 of the flange 43 in the state where the movable core 50 accelerates to some extent. Thereby, in the fuel injection valve 1, a relatively large force in the valve opening direction can be exerted to the needle 40.

Second Embodiment

Figure 3:
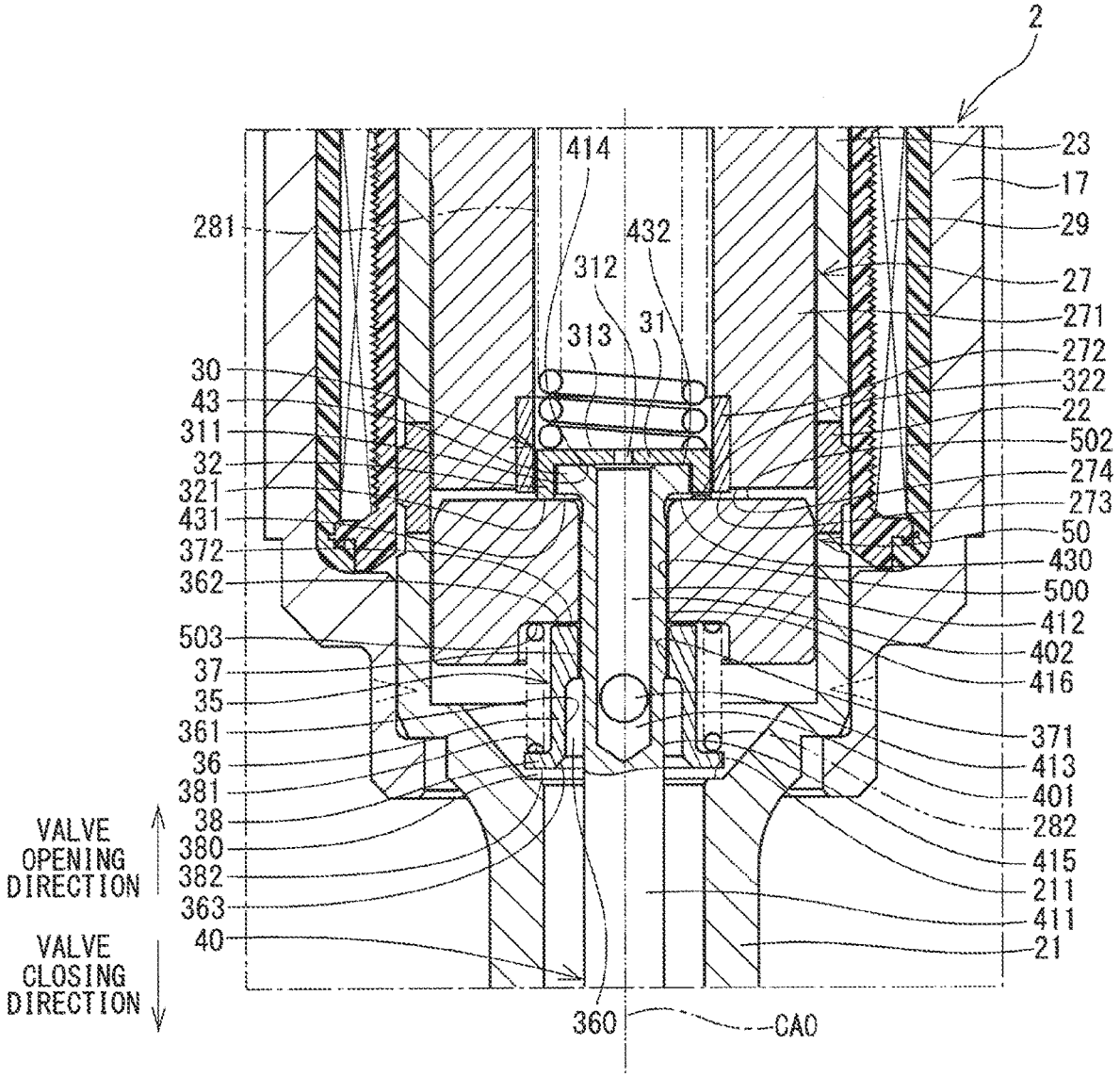
FIG. 3 is a cross-sectional view of a fuel injection valve according to a second embodiment of the present disclosure.

Next, a fuel injection valve according to a second embodiment of the present disclosure will be described with reference to FIG. 3. The second embodiment differs from the first embodiment with respect to that a narrow space, which has a relatively small cross sectional area, is provided between the limiting member and the housing. Portions, which are substantially the same as those of the first embodiment, will be indicated by the same reference signs and will not be described redundantly. FIG. 3 shows the valve opening direction, which is the moving direction of the needle 40 away from the valve seat 255, and the valve closing direction, which is the moving direction of the needle 40 toward the valve seat 255 for contacting with the valve seat 255.

In the fuel injection valve 2 of the second embodiment, the first tubular member 21 includes a flow passage that has a relatively small cross sectional area and is located on the valve seat 255 side of the outside projection 38 of the limiting member 35. Specifically, as shown in FIG. 3, a gap (serving as the narrow space) 380 is formed between an end surface (serving as an end surface of the limiting member located on the valve seat side) 382 of the outside projection 38 located on the valve seat 255 side and the inner wall (serving as an inner wall of the housing that is opposed to the end surface of the limiting member located on the valve seat side) 211 of the first tubular member 21, which is opposed to the end surface 382.

In the fuel injection valve 2, when the needle 40 is moved in the valve closing direction, the gap 380 is progressively reduced. Thereby, a damper effect is generated by the fuel in the gap 380. The moving velocity of the needle 40 in the valve closing direction is reduced by the damper effect, so that collision of the needle 40 against the valve seat 255 at a relatively high velocity is limited. Thereby, in the second embodiment, it is possible to limit a damage of the seal portion 42 and the valve seat 255, which would be otherwise caused by the collision of the seal portion 42 against the valve seat 255 at the valve closing time.

Third Embodiment

Figure 4:
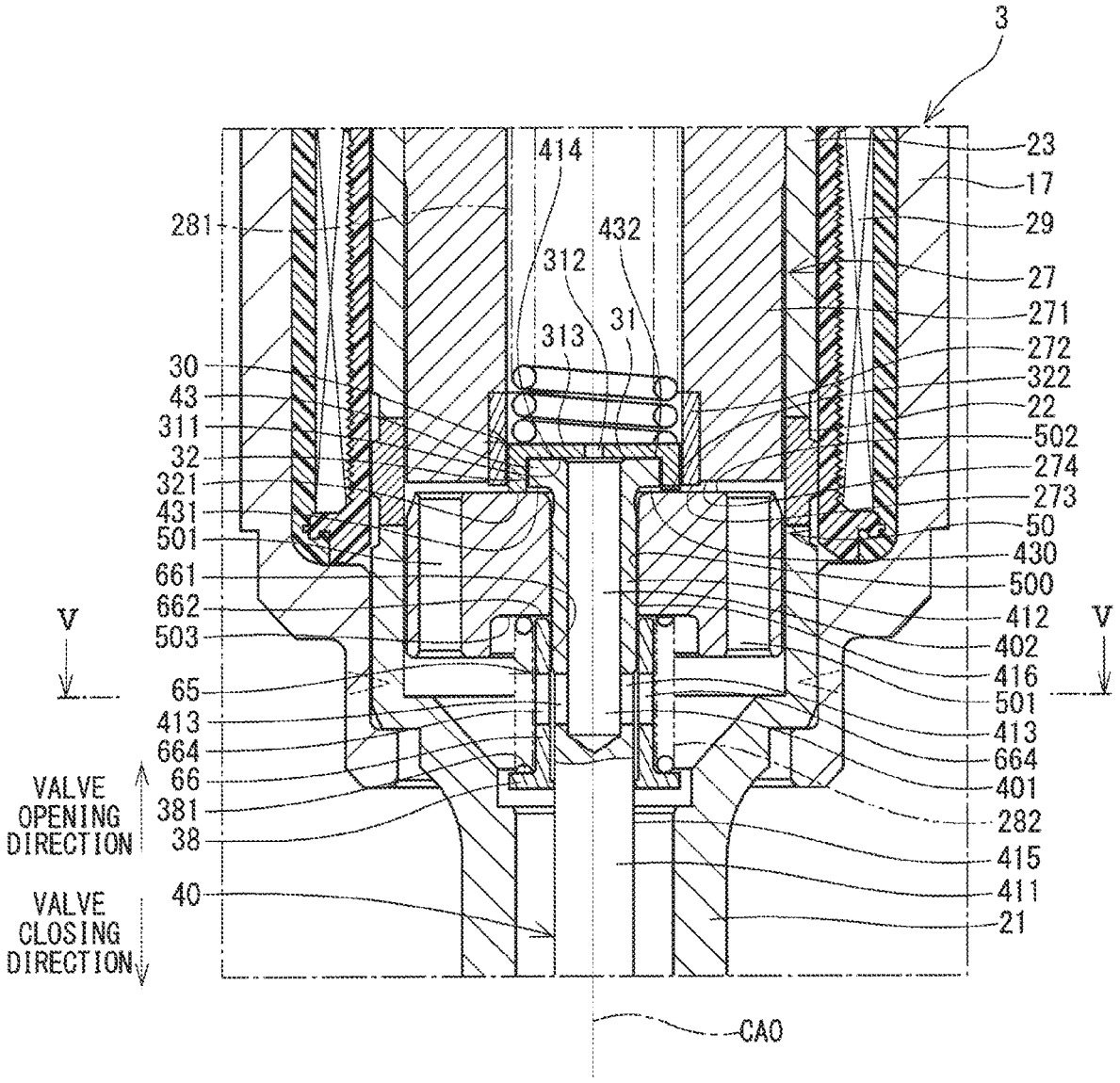
FIG. 4 is a cross-sectional view of a fuel injection valve according to a third embodiment of the present disclosure.
Figure 5:
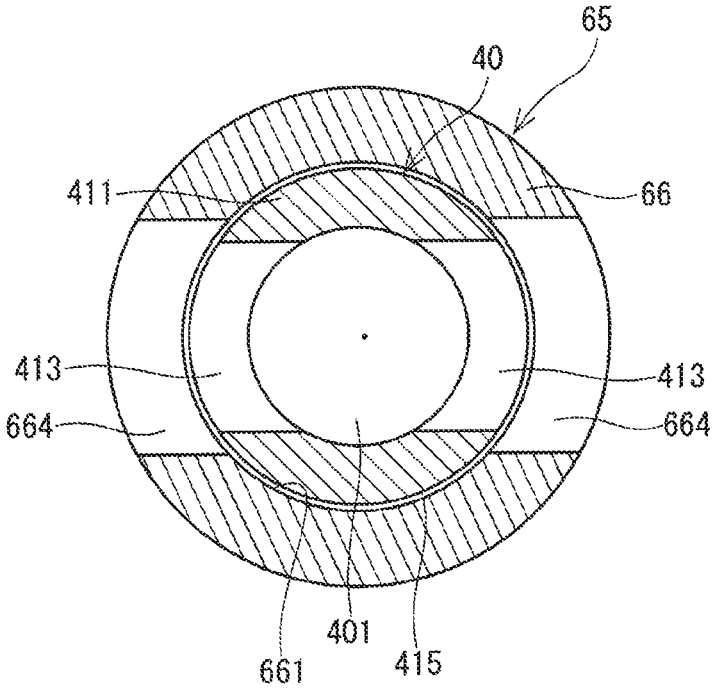
FIG. 5 is a cross-sectional view taken along line V-V in FIG. 4.

Next, a fuel injection valve according to a third embodiment of the present disclosure will be described with reference to FIGS. 4 and 5. The third embodiment differs from the first embodiment with respect to the shape of the limiting member. Portions, which are substantially the same as those of the first embodiment, will be indicated by the same reference signs and will not be described redundantly. FIG. 4 shows the valve opening direction, which is the moving direction of the needle 40 away from the valve seat 255, and the valve closing direction, which is the moving direction of the needle 40 toward the valve seat 255 for contacting with the valve seat 255.

The fuel injection valve 3 of the third embodiment includes a limiting member 65. The limiting member 65 is fixed to the needle 40 by press fitting and laser welding. The limiting member 65 includes a tubular portion (serving as a contact portion) 66 and an outside projection 38.

The tubular portion 66 is placed on the radially outer side of the small diameter portion 411 and the large diameter portion 412. At an inner wall 661 of the tubular portion 66, an inner wall of an end part of the tubular portion 66, which is opposite from the valve seat 255, is fixed to the outer wall 416 of the large diameter portion 412. Furthermore, at the inner wall 661 of the tubular portion 66, an inner wall of an end part of the tubular portion 66, which is located on the valve seat 255 side, is welded to the outer wall 415 of the small diameter portion 411 by laser welding. An end surface 662 of the tubular portion 66, which is opposite from the valve seat 255, is formed to be contactable with the end surface 503 of the movable core 50.

The tubular portion 66 includes a plurality of communication holes 664, which extend through a wall of the tubular portion 66 in the radial direction. As shown in FIG. 5, the communication holes 664 are formed at locations that correspond to the openings 413 of the small diameter portion 411. Each of the communication holes 664 communicates between the corresponding opening 413 and the outside of the limiting member 65.

In the fuel injection valve 3, the end part of the limiting member 65, which is opposite from the valve seat 255, is fixed to the large diameter portion 412, and the end part of the limiting member 65, which is located on the valve seat 255 side, is laser welded to the small diameter portion 411. The limiting member 65, which has the two end parts fixed to the needle 40, includes the communication holes 664, each of which communicates between the corresponding opening 413 and the outside of the limiting member 65. Each of the communication holes 664 forms a part of the fuel passage 18 and conducts the fuel between the opening 413 and the outside of the limiting member 65. Thereby, the required amount of fuel, which is required for the fuel injection, can be reliably conducted from the inlet 14 of the fuel inlet pipe 12 to the inside of the injection nozzle 25.

Furthermore, the end part of the limiting member 65, which is located on the valve seat 255 side, is fixed to the small diameter portion 411 by the laser welding. In this way, at the valve closing time of the fuel injection valve 3, the movement of the limiting member 65 in the valve closing direction, which is caused by the impact force exerted at the time of colliding the movable core 50 against the limiting member 35 upon movement of the movable core 50 in the valve closing direction, is limited. Therefore, it is possible to limit a change in the urging force of the second spring 282 through use of the fuel injection valve 3.

Fourth Embodiment

Figure 6:
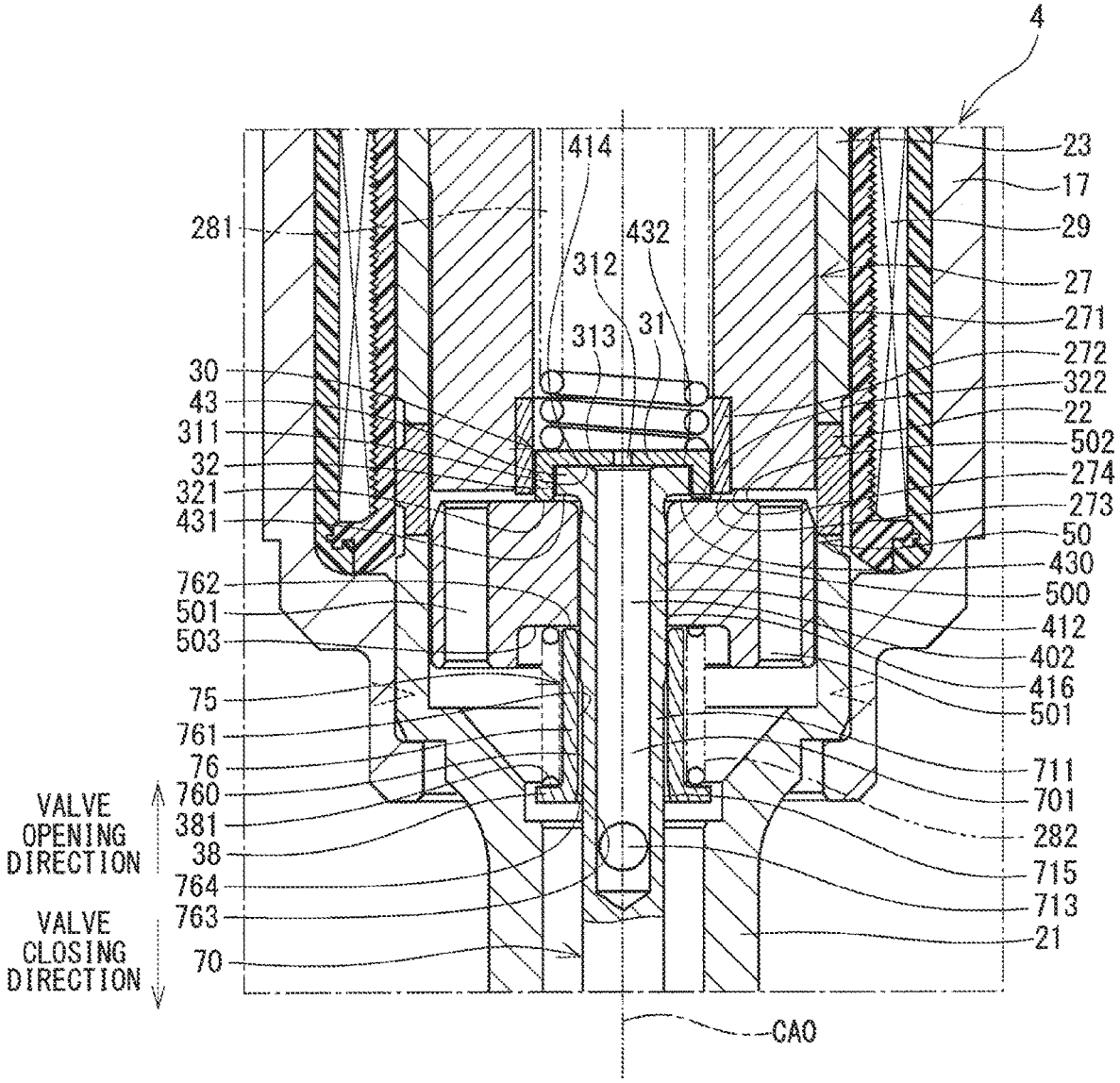
FIG. 6 is a cross-sectional view of a fuel injection valve according to a fourth embodiment of the present disclosure.

Next, a fuel injection valve according to a fourth embodiment of the present disclosure will be described with reference to FIG. 6. The fourth embodiment differs from the first embodiment with respect to the shape of the needle and the shape of the limiting member. Portions, which are substantially the same as those of the first embodiment, will be indicated by the same reference signs and will not be described redundantly. FIG. 6 shows the valve opening direction, which is the moving direction of the needle 70 away from the valve seat 255, and the valve closing direction, which is the moving direction of the needle 70 toward the valve seat 255 for contacting with the valve seat 255.

The fuel injection valve 4 of the fourth embodiment includes the needle 70 and the limiting member 75.

The needle 70 includes the small diameter portion 711, the large diameter portion 412, the seal portion 42, the slidable portion 44 and the flange 43. The small diameter portion 711, the large diameter portion 412, the seal portion 42 and the flange 43 are formed integrally in one-piece. The small diameter portion 711, the large diameter portion 412 and the seal portion 42 correspond to a needle member of the present disclosure.

The small diameter portion 711 is shaped into a rod form and is placed in the inside of the first tubular member 21 in a manner that enables reciprocation of the small diameter portion 711. The seal portion 42 is formed on the valve seat 255 side of the small diameter portion 411. The large diameter portion 412 is formed on an opposite side of the small diameter portion 411, which is opposite from the valve seat 255. The end part of the small diameter portion 711, which is located on the side where the large diameter portion 412 is formed, includes a flow passage 701. The flow passage 701 serves as a fuel flow passage, through which the fuel is flowable. The flow passage 701 is formed such that a length of the flow passage 701, which is measured in the axial direction of the central axis CAO, is larger than that of the flow passage 401 of the first embodiment. The flow passage 701 is communicated with the flow passage 402. The flow passage 701 is communicated with openings 713, each of which serves as a fuel flow passage and is formed to extend through a wall of the small diameter portion 711 in the radial direction. The openings 713 are formed on the valve seat 255 side of the limiting member 75, as shown in FIG. 6.

The limiting member 75 is fixed to the needle 40 by, for example, press fitting. The limiting member 75 includes a tubular portion (serving as a contact portion) 76 and an outside projection 38.

The tubular portion 76 is placed on the radially outer side of the small diameter portion 411 and the large diameter portion 412. At an inner wall 761 of the tubular portion 76, an inner wall of an end part of the tubular portion 76, which is opposite from the valve seat 255, is fixed to the outer wall 416 of the large diameter portion 412. Furthermore, at the inner wall 761 of the tubular portion 76, an inner wall of an end part of the tubular portion 76, which is located on the valve seat 255 side, forms a gap (serving as a damper space) 760 between the inner wall of the end part of the tubular portion 76 and the outer wall 715 of the small diameter portion 711. The gap 760 has an opening 764 at the valve seat 255 side. The fuel can flow into or out of the gap 760. An end surface 762 of the tubular portion 76, which is opposite from the valve seat 255, is formed to be contactable with the end surface 503 of the movable core 50. The inner edge section 763 of the tubular portion 76, which is located on the valve seat 255 side, has a slope surface that is progressively spaced away from the central axis CAO from the opposite side, which is opposite from the valve seat 255, toward the valve seat 255 side.

The openings 713 of the needle 70, which form the corresponding part of the fuel passage 18, are formed on the valve seat 255 side of the limiting member 75. Thereby, the required amount of fuel, which is required for the fuel injection, can be reliably conducted to the inside of the injection nozzle 25 without being interfered with the limiting member 75.

At the fuel injection valve 4, when the needle 70 is moved in the valve closing direction, the fuel is forced to flow in the gap 760 through the opening between the inner edge section 763 of the limiting member 75 and the outer wall 715 of the small diameter portion 711. Because of the forced flow of the fuel into the gap 760, an appropriate amount of resistance is applied to the needle 70, and thereby a moving velocity of the needle 70 in the valve closing direction is reduced. Thereby, it is possible to limit collision of the needle 70 against the valve seat 255 at a relatively high velocity. As a result, in the fourth embodiment, it is possible to limit a damage of the seal portion 42 and the valve seat 255, which would be otherwise caused by the collision of the seal portion 42 against the valve seat 255 at the valve closing time.

Furthermore, the inner edge section 763 of the tubular portion 76, which is located on the valve seat 255 side and forms the gap 760, has a slope surface that is progressively spaced away from the central axis CAO from the opposite side, which is opposite from the valve seat 255, toward the valve seat 255 side. Thereby, the flow of the fuel into or out of the gap 760 can be smoothly carried out.

Fifth Embodiment

Figure 7:
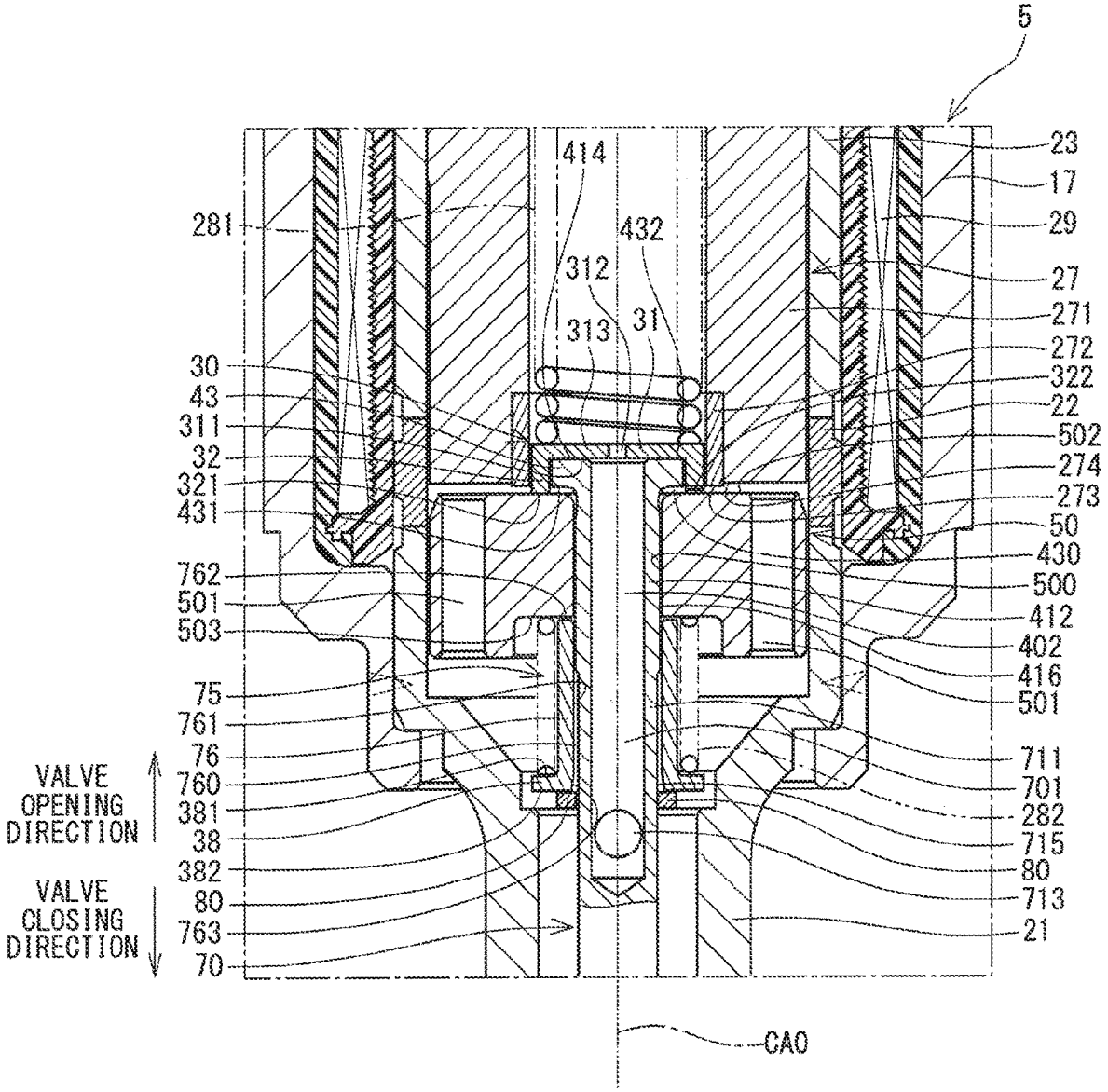
FIG. 7 is a cross-sectional view of a fuel injection valve according to a fifth embodiment of the present disclosure.

Next, a fuel injection valve according to a fifth embodiment of the present disclosure will be described with reference to FIG. 7. The fifth embodiment differs from the fourth embodiment with respect to provision of a movement limiting portion. Portions, which are substantially the same as those of the fourth embodiment, will be indicated by the same reference signs and will not be described redundantly. FIG. 7 shows the valve opening direction, which is the moving direction of the needle 70 away from the valve seat 255, and the valve closing direction, which is the moving direction of the needle 70 toward the valve seat 255 for contacting with the valve seat 255.

The fuel injection valve 5 of the fifth embodiment includes the movement limiting portion 80. The movement limiting portion 80 is a member that is shaped into a circular ring form and is fixed to the outer wall 715 of the small diameter portion 711 at a location that is on the valve seat 255 side of the limiting member 75. The movement limiting portion 80 contacts the end surface 382 of the outside projection 38 of the limiting member 75.

At the fuel injection valve 5, the movement limiting portion 80 can limit movement of the limiting member 75 in the valve closing direction caused by the impact force exerted at the time of colliding the movable core 50 against the limiting member 75 upon movement of the movable core 50 in the valve closing direction. Thereby, the relative position of the limiting member 75, which is relative to the movable core 50 through the needle 70 and defines the urging force of the second spring 282, can be kept unchanged.

Sixth Embodiment

Figure 8:
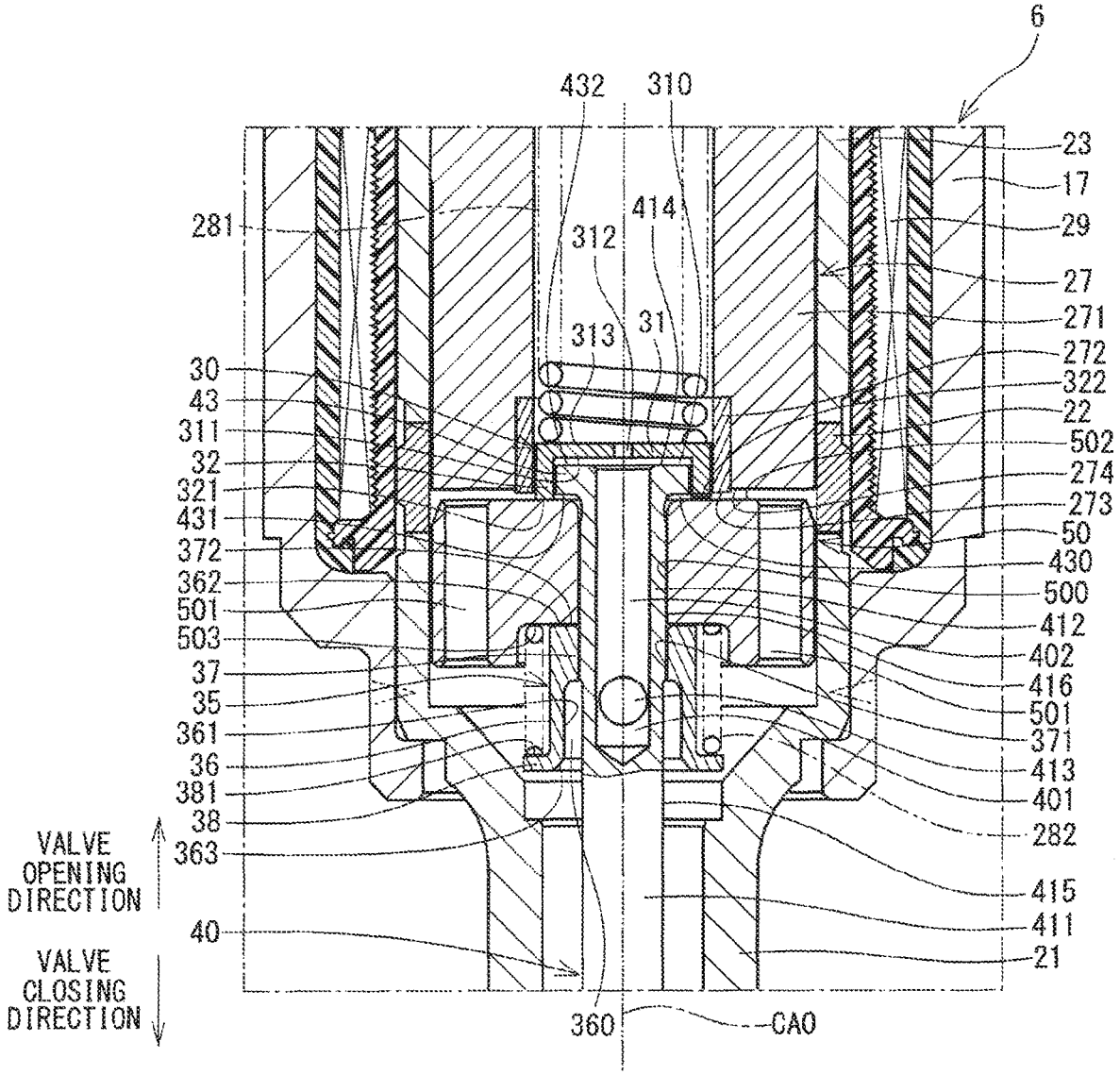
FIG. 8 is a cross-sectional view of a fuel injection valve according to a sixth embodiment of the present disclosure.

Next, a fuel injection valve according to a sixth embodiment of the present disclosure will be described with reference to FIG. 8. The sixth embodiment differs from the first embodiment with respect to presence of a gap between the flange and the movable core and a gap between the flange and the plate portion at the valve closing time. Portions, which are substantially the same as those of the first embodiment, will be indicated by the same reference signs and will not be described redundantly. FIG. 8 shows the valve opening direction, which is the moving direction of the needle 40 away from the valve seat 255, and the valve closing direction, which is the moving direction of the needle 40 toward the valve seat 255 for contacting with the valve seat 255.

FIG. 8 is a cross-sectional view of the fuel injection valve 6 of the sixth embodiment. In a state shown in FIG. 8, the seal portion 42 contacts the valve seat 255. At this time, the tubular portion 32 contacts the movable core 50, and the movable core 50 contacts the limiting member 35. Furthermore, the end surface 431 of the flange 43, which is located on the valve seat 255 side, forms the gap 430 between the end surface 431 and the end surface 502, and the end surface 432 of the flange 43, which is opposite from the valve seat 255, forms the gap 310 between the end surface 432 and the end surface 311 of the plate portion 31 of the flange receiving member 30.

In the sixth embodiment, when the magnetic attractive force is generated between the stationary core 27 and the movable core 50 in the state shown in FIG. 8, the movable core 50 moves and accelerates in the valve opening direction through the distance, which corresponds to the length of the gap 430 in the axial direction of the central axis CAO, and then the end surface 502 of the movable core 50 contacts the end surface 431 of the flange 43. Thereby, in the fuel injection valve 6, a relatively large force in the valve opening direction can be exerted to the needle 40.

Figure 9:
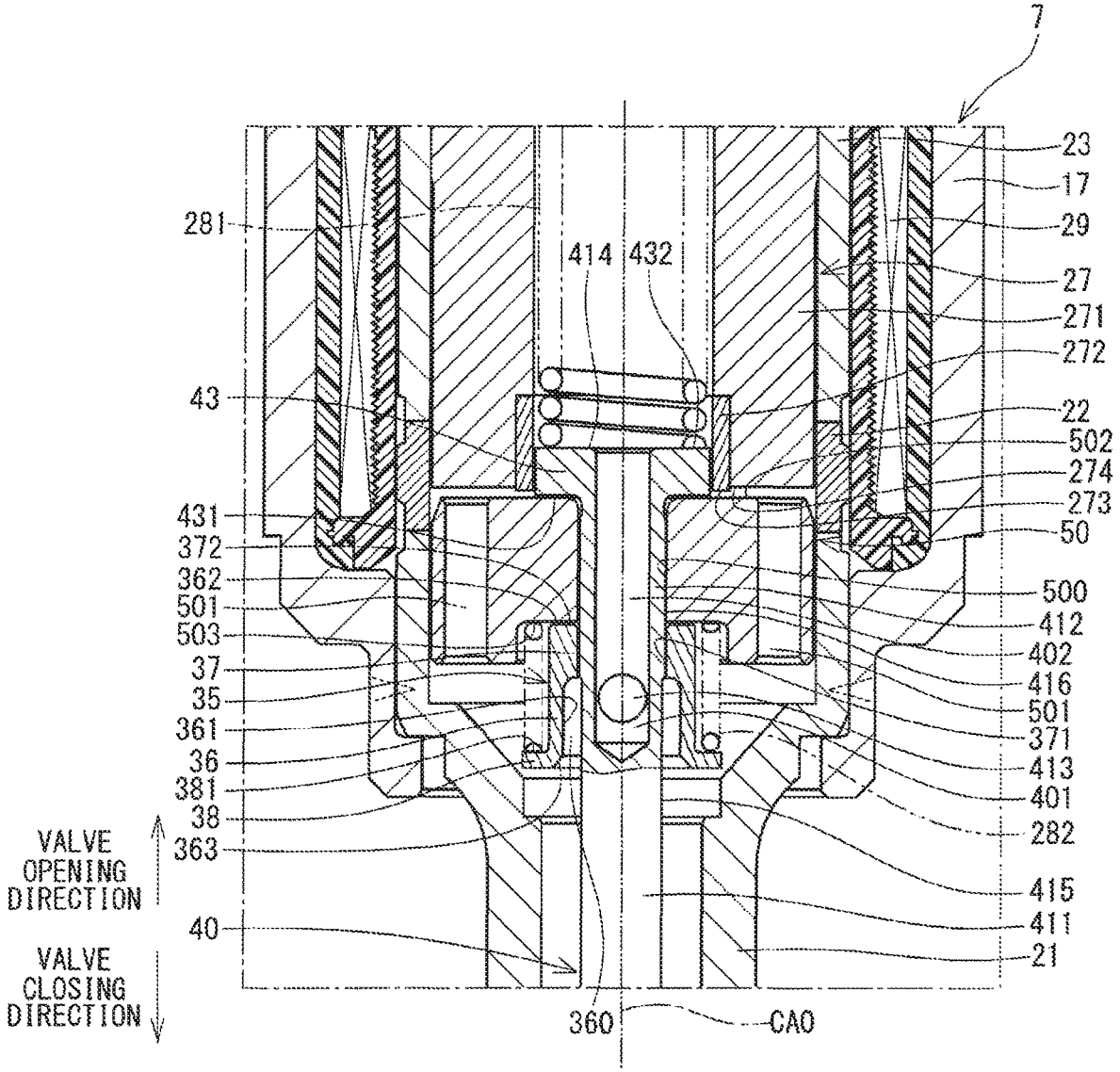
FIG. 9 is a cross-sectional view of a fuel injection valve according to another embodiment of the present disclosure.

Other Embodiments (1) In the fuel injection valve of the respective embodiments described above, in the state where the plate portion of the flange receiving member contacts the needle, and the tubular portion of the flange receiving member contacts the movable core, the gap is formed between the end surface of the movable core, which is opposite from the valve seat, and the end surface of the flange, which is located on the valve seat side. Alternatively, it is possible to provide a fuel injection valve that does not have this gap. FIG. 9 indicates a fuel injection valve 7 that does not have the flange receiving member. In this fuel injection valve 7, when the seal portion 42 contacts the valve seat 255, the end surface 431 of the flange 43 contacts the end surface 502 of the movable core 50. Even in this fuel injection valve 7, the provision of the limiting member of the present disclosure can limit the rebound of the movable core 50 by the limiting member 35 that supports the second spring 282.

(2) In the fuel injection valve of the respective embodiments described above, the needle includes the fuel flow passage. Alternatively, the fuel flow passage may be eliminated from the needle.

(3) In the above embodiments, the limiting member includes the tubular portion and the outside projection. However, the configuration of the limiting member should not be limited to this configuration. It is only required that on the valve seat side of the flange, the movable core is installed such that the movable core is movable between the limiting member and the flange, and the limiting member includes the support portion and the contact portion while the contact portion is contactable with the movable core.

(4) In the first and second embodiments, the end surface of the inside projection, which is opposite from the valve seat, is flush with the end surface of the tubular portion, which is opposite from the valve seat. Alternatively, the end surface of the inside projection, which is opposite from the valve seat, may not be flush with the end surface of the tubular portion, which is opposite from the valve seat. It is only required that at least one of the end surface of the inside projection, which is opposite from the valve seat, or the end surface of the tubular portion, which is opposite from the valve seat, is contactable with the movable core at the time of moving the movable core in the valve closing direction.

(5) In the first and second embodiments, the end part of the limiting member, which is located on the movable core side, is securely press fitted to the large diameter portion. However, the location of press fitting the limiting member should not be limited to this location.

(6) In the fifth embodiment, the movement limiting portion is the single member that is shaped into the circular ring form. However, the shape and the number of the movement limiting portion(s) should not be limited to the above described shape and the number. The movement limiting portion may be made of a plurality of arcuate members and may be arranged one after another at equal intervals in a circumferential direction at, for example, the outer wall of the small diameter portion. In such a case, the damper space, which is formed between the outer wall of the small diameter portion of the needle and the inner wall of the limiting member, is communicated with the outside of the limiting member through gaps, each of which is defined between circumferentially adjacent two of the members of the movement limiting portion. Therefore, the fuel can be smoothly flown.

(7) The fuel injection valve of each of the fourth and fifth embodiments may include the narrow space that is formed between the end surface of the limiting member, which is located on the valve seat side, and the inner wall of the housing, which is opposed to the end surface of the limiting member.

(8) The fuel injection valve of the first to third embodiments may include the movement limiting portion. In such a case, the movement limiting portion is made of a plurality of arcuate members, so that the communication passage, which is formed between the outer wall of the small diameter portion of the needle and the inner wall of the limiting member, is communicated with the outside of the limiting member through gaps, each of which is defined between adjacent two of the members of the movement limiting portion. Therefore, the fuel can be smoothly flown.

The present disclosure should not be limited to the above embodiments and may be embodied in various forms without departing from the scope of the present disclosure.

The invention claimed is:

1. A fuel injection valve comprising:

a needle member that is configured to open or close an injection hole, which is configured to inject fuel;

a stationary core that is configured to generate a magnetic attractive force in response to energization of a coil of the fuel injection valve;

a movable core that is configured to contact and urge the needle member to implement a valve opening movement of the needle member in a direction away from the injection hole when the movable core is magnetically attracted toward the stationary core and is thereby moved by a predetermined amount toward a counter-injection hole side that is a side away from the injection hole;

a spring retainer that is fixed to the needle member;

a first spring that is configured to be resiliently deformed in response to the valve opening movement of the needle member and then exert a first resilient force against the needle member to implement a valve closing movement of the needle member toward the injection hole; and a second spring that has:

one end in contact with a counter-injection hole side surface of the spring retainer located on the counter-injection hole side; and another end in contact with an injection hole side surface of the movable core located on an injection hole side where the injection hole is located, while the second spring is configured to be resiliently deformed and then exert a second resilient force to urge the movable core toward the counter-injection hole side, wherein:

the needle member includes a press-fitting segment, to which the spring retainer is press fitted toward the counter-injection hole side;

the spring retainer is press fitted to the press-fitting segment and is thereby fixed to the needle member to retain the one end of the second spring and set the second resilient force of the second spring exerted against the movable core;

a portion of the spring retainer is placed on a radially inner side of the second spring; and the needle member has a small diameter portion that is located on the injection hole side of the press-fitting segment, and an outer diameter of the small diameter portion is smaller than an outer diameter of the press-fitting segment.

2. The fuel injection valve according to claim 1, wherein the press-fitting segment has a constant outer diameter along an entire axial extent of the press-fitting segment to enable:

adjustment of an axial position of the spring retainer along the press-fitting segment; and thereby adjustment of the second resilient force of the second spring with the spring retainer at a time when the spring retainer is press fitted to the press-fitting segment.

* * * * *